US010601157B2

(12) United States Patent
Huang

(10) Patent No.: US 10,601,157 B2
(45) Date of Patent: Mar. 24, 2020

(54) ELECTRICAL CONNECTOR

(71) Applicant: LOTES CO., LTD, Keelung (TW)

(72) Inventor: Chang Wei Huang, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/426,067

(22) Filed: May 30, 2019

(65) Prior Publication Data

US 2019/0372255 A1 Dec. 5, 2019

(30) Foreign Application Priority Data

May 31, 2018 (CN) ..... 2018 1 0548099

(51) Int. Cl.

| | |
|---|---|
| ***H01R 12/71*** | (2011.01) |
| ***H01R 13/631*** | (2006.01) |
| ***H01R 13/11*** | (2006.01) |
| ***H01R 33/76*** | (2006.01) |

(52) U.S. Cl.

CPC ..... *H01R 12/716* (2013.01); *H01R 13/111* (2013.01); *H01R 13/631* (2013.01); *H01R 33/76* (2013.01)

(58) Field of Classification Search

CPC .... H01R 12/82; H01R 12/716; H01R 13/193; H01R 19/631; H01R 13/111; H01R 33/76

USPC ..... 439/342, 259

See application file for complete search history.

(56) References Cited

U.S. PATENT DOCUMENTS

| | | | | |
|---|---|---|---|---|
| 8,052,436 | B1 * | 11/2011 | Ju | H01R 12/57 439/342 |
| 8,152,553 | B2 * | 4/2012 | Taguchi | H01R 12/57 439/259 |
| 2003/0186576 | A1 * | 10/2003 | Lin | H01R 13/112 439/342 |
| 2004/0009694 | A1 * | 1/2004 | Lai | H01R 12/88 439/342 |
| 2005/0095897 | A1 * | 5/2005 | Hsu | H01R 13/112 439/342 |

(Continued)

FOREIGN PATENT DOCUMENTS

| | | |
|---|---|---|
| CN | 201570752 U | 9/2010 |
| CN | 201781096 U | 3/2011 |

(Continued)

*Primary Examiner* — Gary F Paumen

(74) *Attorney, Agent, or Firm* — Locke Lord LLP; Tim Tingkang Xia, Esq.

(57) ABSTRACT

An electrical connector includes an insulating body provided with multiple accommodating slots. A reserved space is provided between and interconnects two adjacent accommodating slots. Multiple terminals are correspondingly accommodated in the accommodating slots. Each terminal includes a base and two arm portions having two clamping portions and two guiding portions. An oblique portion is formed by bending forward from the base and extending upward. A front surface of the oblique portion has a contact surface. The contact surface and the two clamping portions jointly clamp an insertion pin of a chip module. A rear surface of the oblique portion has a guide surface. A top end of the guide surface is higher than a bottom surface of the reserved space. The guide surface of a front terminal guides the insertion pin to be inserted downward, and the guiding portion of a rear terminal guides the insertion pin to move horizontally.

10 Claims, 7 Drawing Sheets

(56) References Cited

U.S. PATENT DOCUMENTS

| | | | | |
|---|---|---|---|---|
| 2007/0059966 | A1* | 3/2007 | Liao | H01R 4/02 439/342 |
| 2008/0101047 | A1* | 5/2008 | Wang | H01R 12/57 361/767 |
| 2008/0227324 | A1* | 9/2008 | Cheng | H01R 13/11 439/342 |
| 2010/0009563 | A1* | 1/2010 | Hoshikawa | H01R 33/7664 439/342 |
| 2010/0297866 | A1* | 11/2010 | Ju | H01R 13/112 439/342 |

FOREIGN PATENT DOCUMENTS

| | | | |
|---|---|---|---|
| CN | 202134681 | U | 2/2012 |
| CN | 202434732 | U | 9/2012 |

* cited by examiner

ELECTRICAL CONNECTOR

CROSS-REFERENCE TO RELATED PATENT APPLICATION

This non-provisional application claims priority to and the benefit of, pursuant to 35 U.S.C. § 119(a), patent application Serial No. CN201810548099.7 filed in China on May 31, 2018. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and more particularly to an electrical connector allowing insertion pins of a chip module to be inserted therein.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

An electrical connector conventionally used in the industry is used to be electrically connected to a chip module having multiple insertion pins. The electrical connector has an insulating body, an upper cover located above the insulating body, and multiple terminals accommodated in the insulating body. The insulating body is provided with multiple accommodating slots provided at intervals and used to correspondingly accommodate the terminals. Each terminal includes a base matching with a corresponding accommodating slot to retain the terminal. Two arm portions are formed by bending from two opposite sides of the base and extending upward. Each of the two arm portions is respectively provided with a contact portion and a guiding portion connected to the contact portion. A clamping space is formed between the two contact portions of the two arm portions. When the chip module is mounted on the upper cover, the insertion pin is inserted downward into the accommodating slot under the guidance of the side wall of the accommodating slot, and then by the horizontal slide of the upper cover, the insertion pin horizontally moves into the clamping space under the guidance of the guiding portion to be in contact with the contact portion.

However, using the side wall of the accommodating slot to guide the insertion pin will cause the distance between two adjacent terminals to increase, which is not beneficial to the developing trend that the terminals are distributed more densely, and thereby will be detrimental to the higher requirement of the signal transmission.

Therefore, a heretofore unaddressed need to design an improved electrical connector exists in the art to address the aforementioned deficiencies and inadequacies.

SUMMARY

The present invention is directed to an electrical connector which facilitates the terminals to be provided densely and prevents an insertion pin of a chip module from being inserted slantly therein.

To achieve the foregoing objective, the present invention adopts the following technical solutions.

An electrical connector is configured to be electrically connected to a chip module having a plurality of insertion pins. The electrical connector includes: an insulating body, provided with a plurality of accommodating slots running through the insulating body vertically, wherein a reserved space is provided between two adjacent accommodating slots of the accommodating slots in a front-rear direction to interconnect the two adjacent accommodating slots, and the reserved space is configured to correspondingly reserve for a corresponding insertion pin of the insertion pins; and a plurality of terminals, correspondingly accommodated in the accommodating slots, wherein each of the terminals comprises a base being flat plate shaped and two arm portions extending upward from the base, the two arm portions have two clamping portions and two guiding portions formed by bending and extending forward from the two clamping portions and toward directions away from each other, an oblique portion is formed by bending forward from the base and extending upward, a front surface of the oblique portion has a contact surface, the contact surface and the two clamping portions are configured to jointly clamp the corresponding insertion pin, a rear surface of the oblique portion has a guide surface, a top end of the guide surface is higher than a bottom surface of the reserved space; wherein the terminals comprise two adjacent terminals in the front-rear direction, and when the chip module is mounted, the guide surface of a front terminal of the two adjacent terminals guides the corresponding insertion pin to be inserted downward, and then the guiding portions of a rear terminal of the two adjacent terminals guides the corresponding insertion pin to move horizontally.

In certain embodiments, the base comprises an elastic portion connected to a bottom end of the oblique portion, and a width of the elastic portion is greater than a width of the oblique portion along a left-right direction; the bottom surface of the reserved space is lower than the bottom end of the oblique portion, and the reserved space is located behind the elastic portion to provide an elastic deformation space for the elastic portion; and a stopping portion extends downward from the elastic portion and inclines backward to stop the corresponding terminal from moving downward.

In certain embodiments, the stopping portion enters the reserved space, and the stopping portion and the bottom surface of the reserved space match to stop the corresponding terminal from moving downward.

In certain embodiments, the base has a through hole being of an enclosed quadrangle shape, the stopping portion is formed by extending downward from an upper edge of the through hole and inclining backward, and a width of the through hole is respectively greater than the width of the oblique portion and a width of the stopping portion along the left-right direction.

In certain embodiments, the base further comprises a retaining portion lower than the arm portions, the retaining portion and the corresponding accommodating slot match to retain the corresponding terminal, and a width of the retaining portion is greater than the width of the elastic portion along the left-right direction.

In certain embodiments, a left side wall and a right side wall of each of the accommodating slots are respectively provided with two slots running through the insulating body vertically, the retaining portion and the two slots of the corresponding accommodating slot match to retain the corresponding terminal, and two sides of the elastic portion are accommodated in the slots and do not abut the side surfaces of the slots.

In certain embodiments, a rear side wall of each of the accommodating slots is provided with a recess portion running downward through a bottom surface of the insulating body, and a top surface of the recess portion is lower than the bottom surface of the reserved space.

In certain embodiments, a bottom surface of each of the insertion pins is lower than a bottom end of the oblique portion.

In certain embodiments, a front edge of each of the guiding portion forms a guide edge, an included angle between the guide edge and an upper end of the guiding portion is an obtuse angle, a bending line at a connecting location of each of the guiding portions and the corresponding clamping portion is an oblique line, and the oblique line inclines backward along a direction upward from bottom.

In certain embodiments, a clamping space is formed between the two clamping portions, the contact surface enters the clamping space, and the guide surface does not enter the clamping space.

Compared with the related art, certain embodiments of the present invention have the beneficial effects:

In certain embodiments of the present invention, a reserved space is provided between the two adjacent accommodating slots in the front-rear direction to reserve for a corresponding insertion pin, such that the terminals can be arranged more densely. Each terminal is provided with the oblique portion, and the rear surface of the oblique portion forms the guide surface. When the chip module is mounted, the insertion pin is inserted downward under the guidance of the guide surface of the terminal in front of the insertion pin, thereby reducing a risk of slant insertion of the insertion pin. The front surface of the oblique portion forms the contact surface, such that a sufficient elastic pressing force can be generated when the contact surface is in contact with the insertion pin, so as to ensure a stable contact with the insertion pin.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
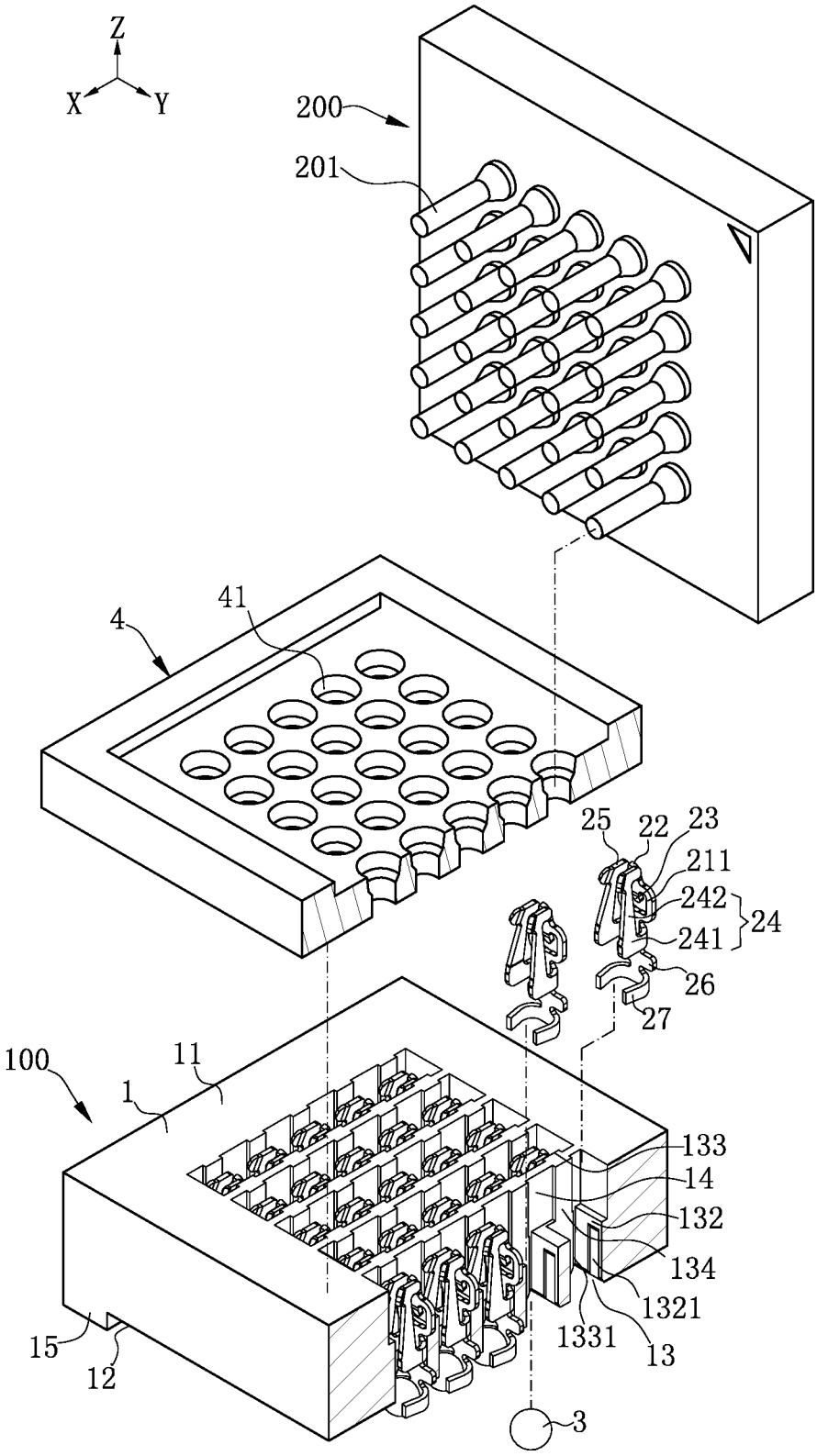
FIG. 1 is a perspective exploded sectional view of an electrical connector and a chip module according to certain embodiments of the present invention.
Figure 2:
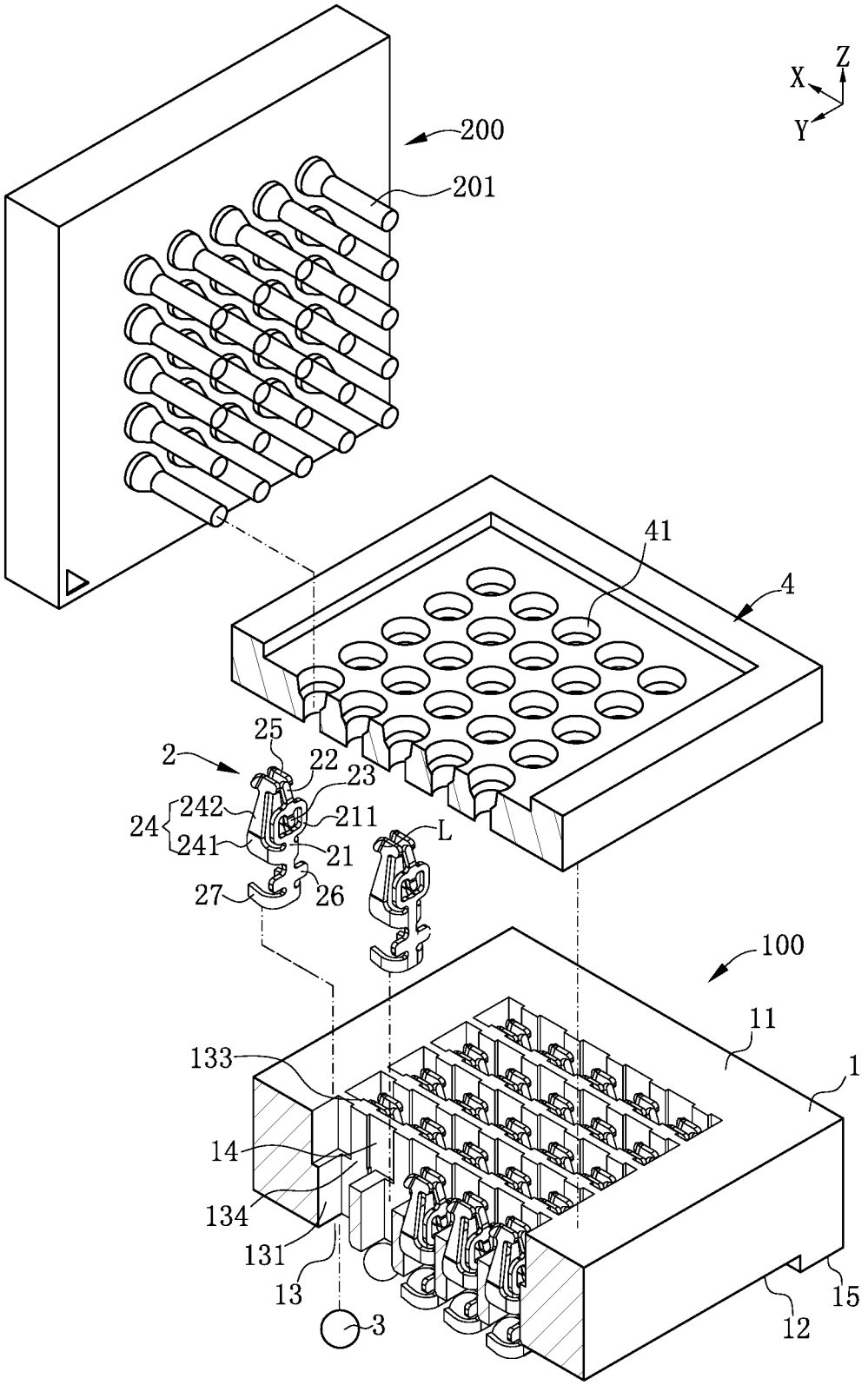
FIG. 2 is a perspective exploded sectional view of FIG. 1 from another viewing angle.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-7. In accordance with the purposes of this invention, as embodied and broadly described herein, this invention, in one aspect, relates to an electrical connector.

FIG. 1 to FIG. 7 show an electrical connector according to one embodiment of the present invention. An electrical connector 100 according to the embodiment of the present invention is used to electrically connect a chip module 200 to a circuit board 300. The chip module 200 has multiple insertion pins 201. The electrical connector 100 includes an insulating body 1, multiple terminals 2 accommodated in the insulating body 1, and an upper cover 4 located above the insulating body 1. The upper cover 4 is used to support the chip module 200, and is provided with multiple penetration holes 41 running through the upper cover 4 vertically to accommodate the insertion pins 201. The upper cover 4 horizontally slides relative to the insulating body 1 by a driving device (not shown in the figures, and accordingly, FIG. 1 and FIG. 2 only show simple schematic views of the upper cover 4 instead of complete views thereof), so as to drive the chip module 200 to move to a final position.

Figure 3:
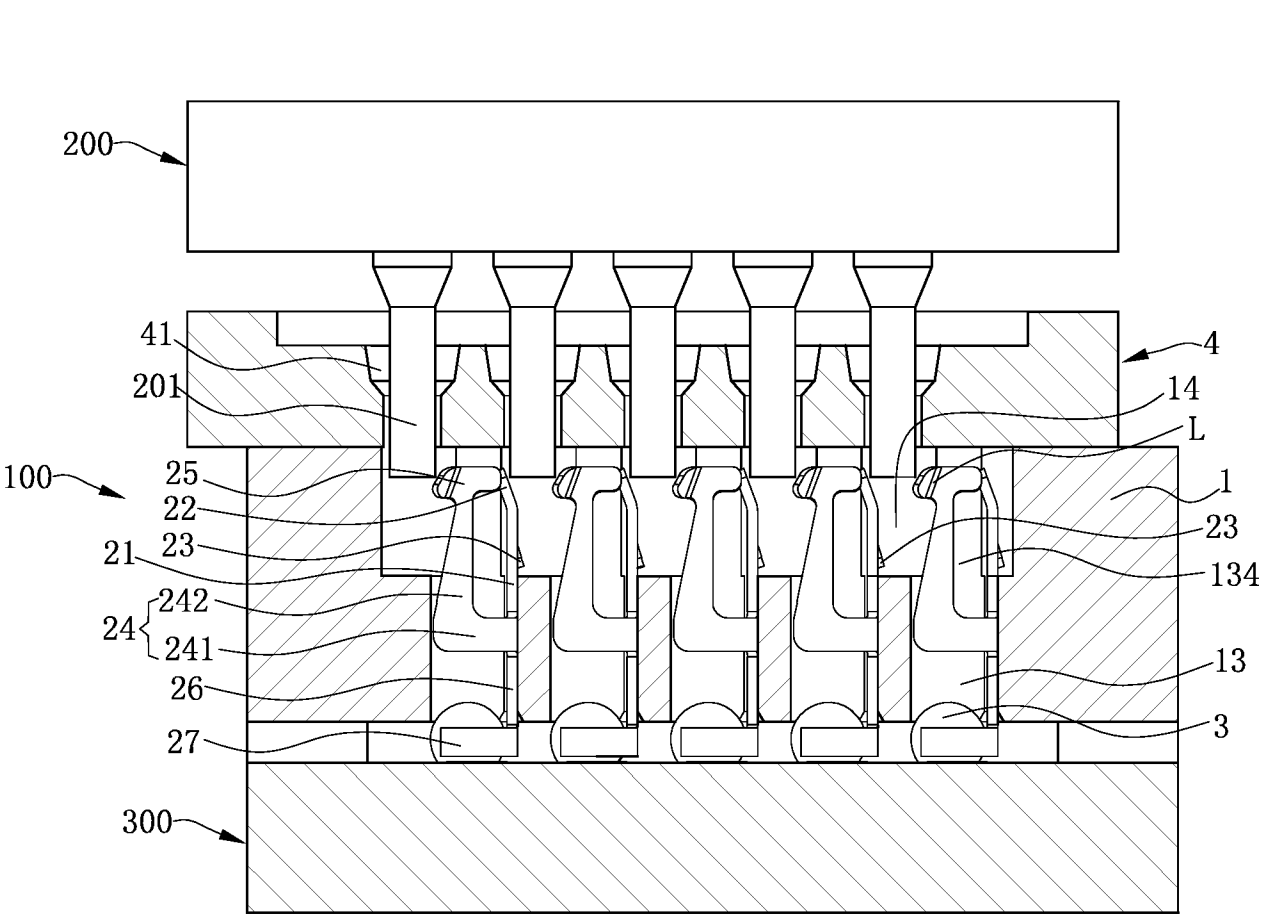
FIG. 3 is a sectional view of a terminal guiding an insertion pin of a chip module to be inserted downward according to certain embodiments of the present invention.
Figure 4:
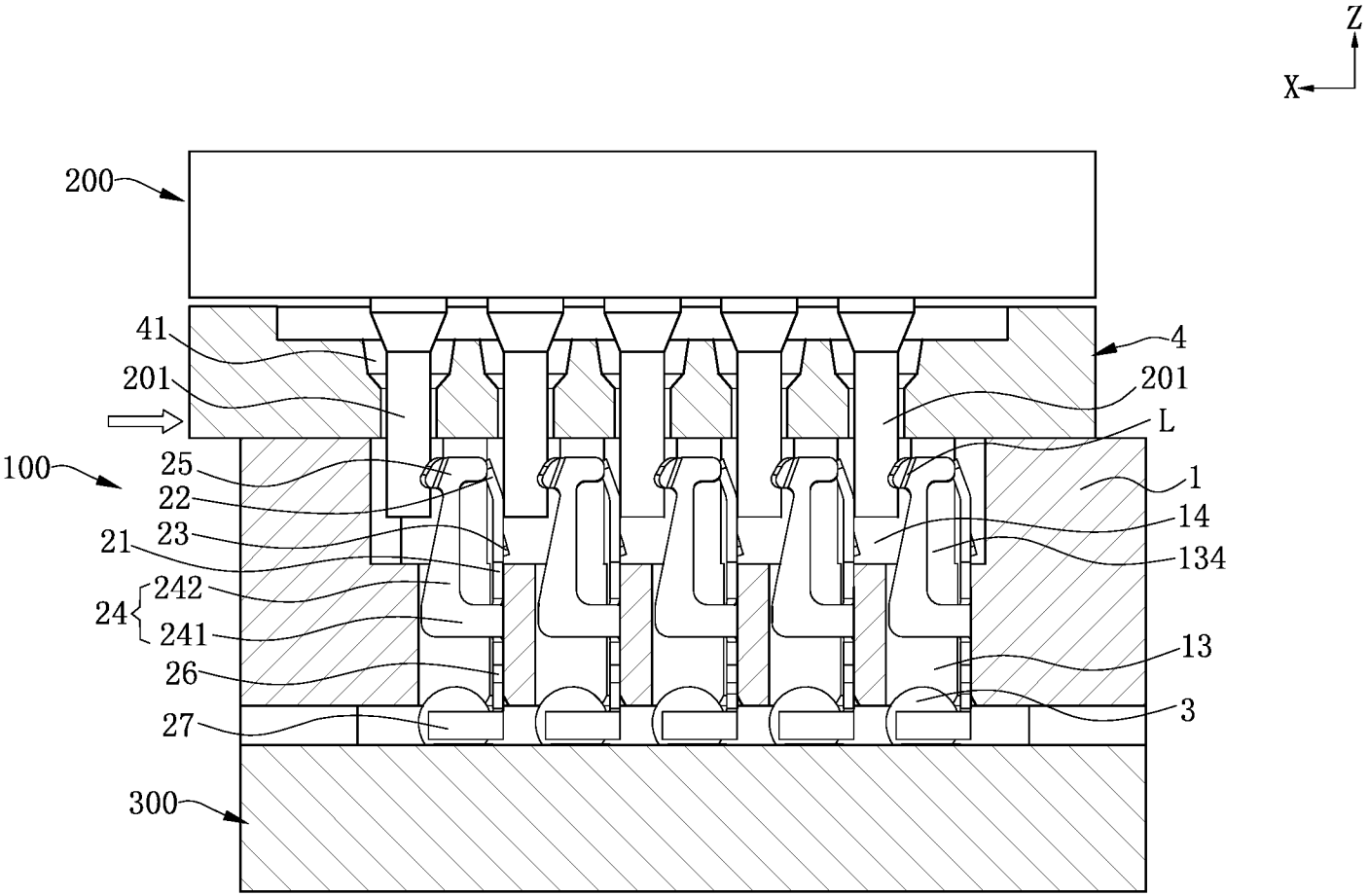
FIG. 4 is a sectional view of an insertion pin of a chip module being inserted downward to a final position according to certain embodiments of the present invention.
Figure 5:
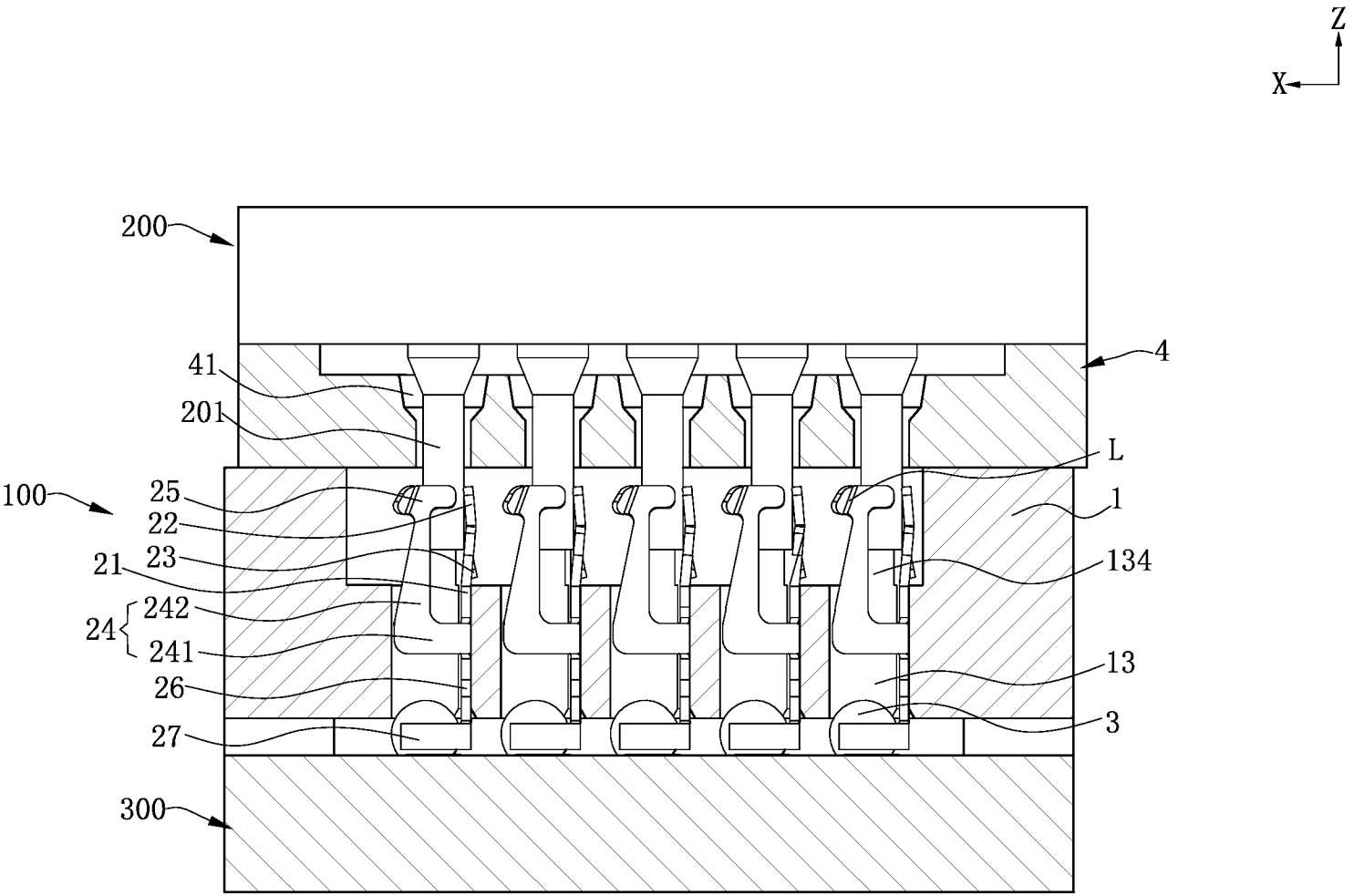
FIG. 5 is a sectional view of an insertion pin of a chip module horizontally moving to a final position according to certain embodiments of the present invention.

As shown in FIG. 1, FIG. 3 and FIG. 4, an X axis is defined as a front-rear direction, a Y axis is defined as a left-right direction, and a Z axis is defined as a vertical direction. The insulating body 1 is provided with multiple accommodating slots 13 arranged in a matrix and running through an upper surface 11 and a lower surface 12 of the insulating body 1. Each accommodating slot 13 has a front side wall 131 and a rear side wall 132 provided opposite to each other, as well as a left side wall 133 and a right side wall 134 connecting the front side wall 131 and the rear side wall 132 and provided opposite to each other. A top end of the front side wall 131 and a top end of the rear side wall 132 are respectively lower than the upper surface 11, such that a reserved space 14 is formed between the two adjacent accommodating slots 13 in the front-rear direction to enable the two accommodating slots 13 to be interconnected, and is used to correspondingly reserve a corresponding insertion pin 201. The rear side wall 132 is provided with a recess portion 1321 running downward through the lower surface 12. A top surface of the recess portion 1321 is lower than a bottom surface of the reserved space 14. Each of the left side wall 133 and the right side wall 134 are respectively provided with a slot 1331 running through the insulating body 1 vertically, and the slot 1331 is adjacent to the rear side wall 132. A leg 15 is formed to protrude from each of four corners of the lower surface 12 respectively to support the insulating body 1 onto the circuit board 300.

Figure 6:
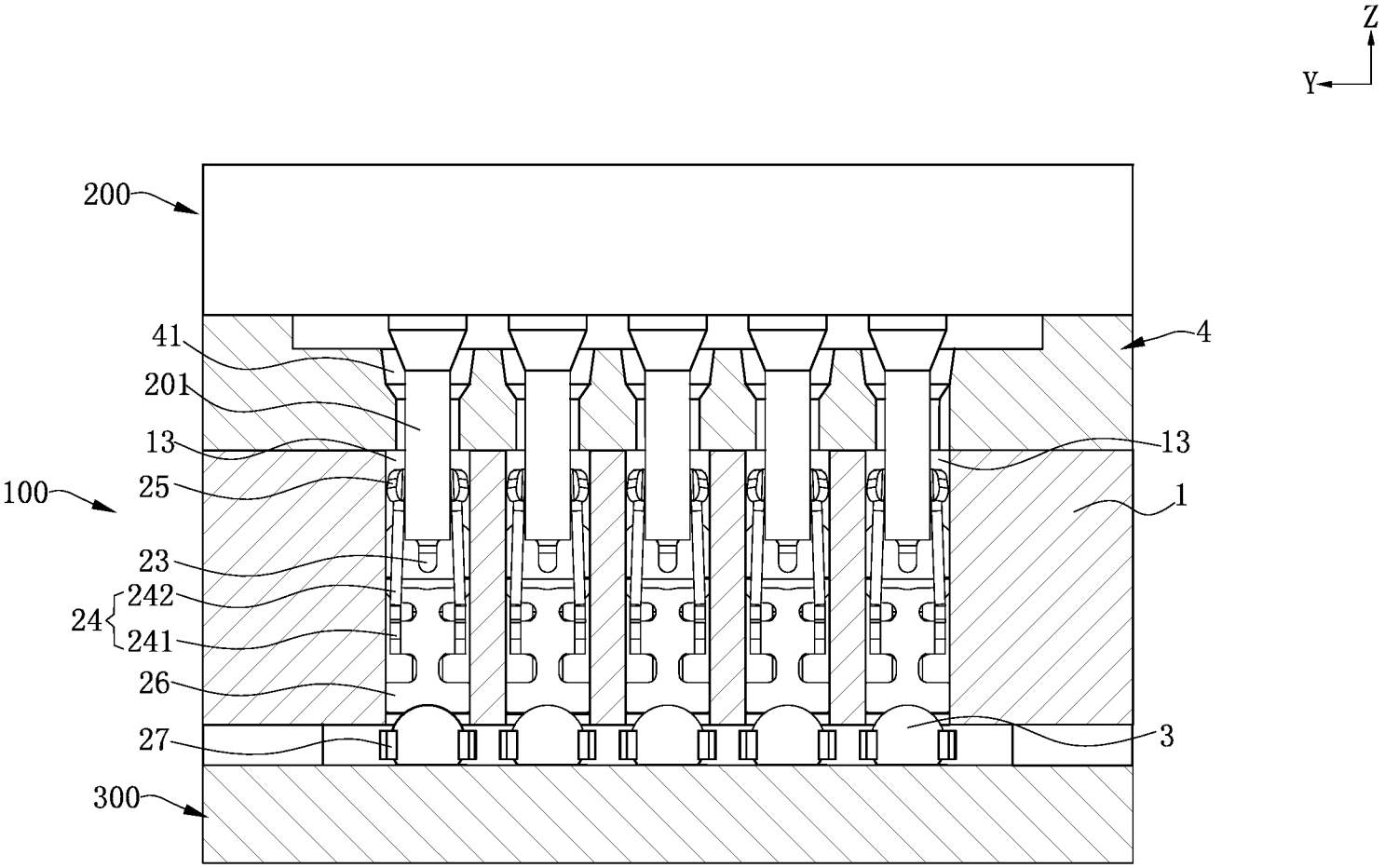
FIG. 6 is a sectional view of FIG. 5 from another viewing angle.
Figure 7:
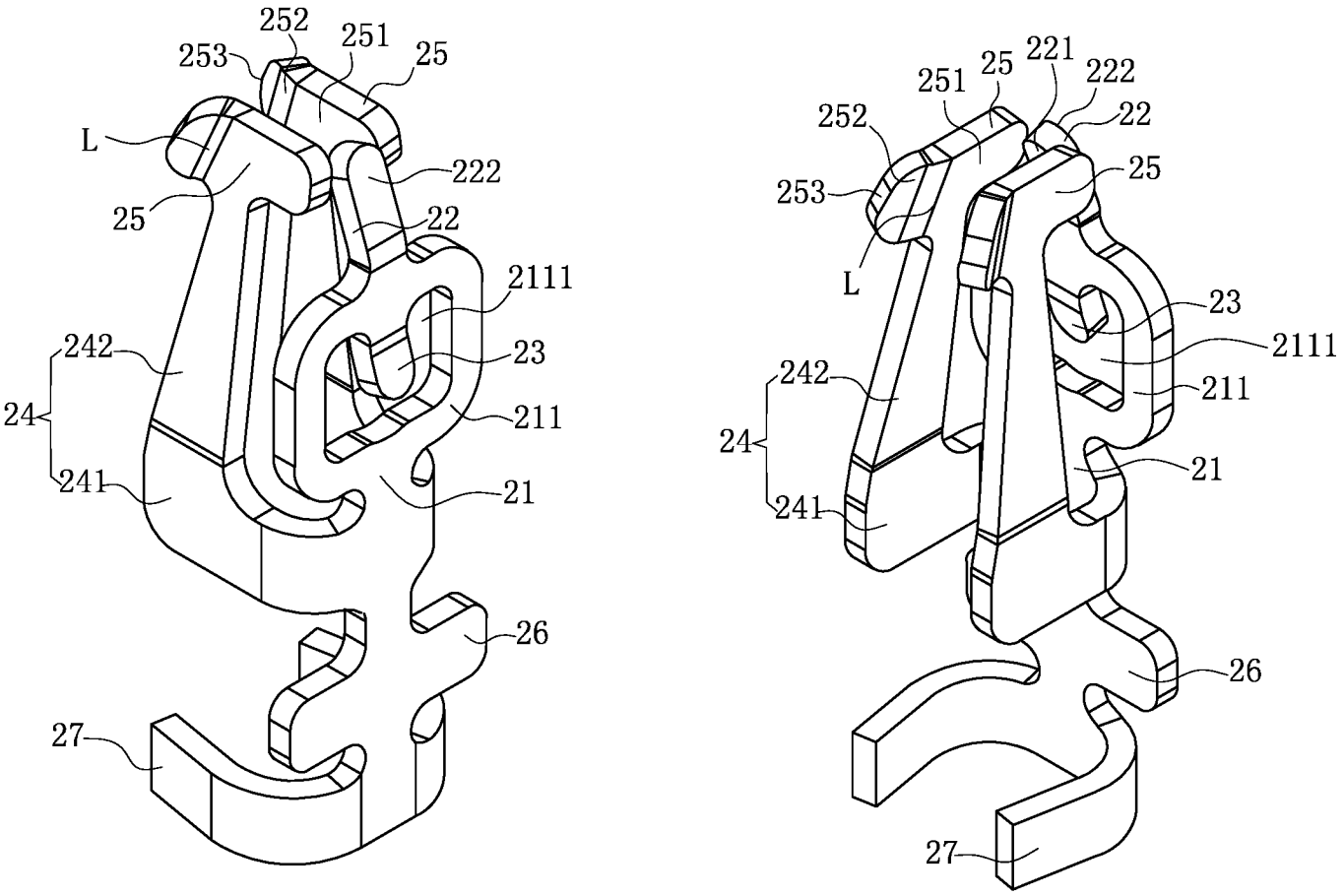
FIG. 7 is a perspective schematic view of a terminal at different angles according to certain embodiments of the present invention.

As shown in FIG. 1, FIG. 6 and FIG. 7, the terminals 2 are correspondingly provided in the accommodating slots 13. Each terminal 2 includes a base 21 which is flat plate shaped. The base 21 includes an elastic portion 211. The elastic portion 211 has a through hole 2111 which is of an enclosed quadrangle shape. An oblique portion 22 is formed by bending forward from a top end of the elastic portion 211 and extending upward. In other embodiments, the oblique portion 22 may also be circular arc-shaped. A bottom surface of the insertion pin 201 is lower than a bottom end of the oblique portion 22. A front surface of the oblique portion 22 has a contact surface 221 to be in contact with the insertion pin 201, and a rear surface of the oblique portion 22 has a guide surface 222 to guide the insertion pin 201 to be inserted downward. A width of the elastic portion 211 is greater than a width of the oblique portion 22 along the left-right direction. The bottom surface of the reserved space 14 is lower than the bottom end of the oblique portion 22, and the reserved space 14 is located behind the elastic portion 211 to provide an elastic deformation space for the elastic portion 211. The four corners of the elastic portion 211 adopt a smooth arc transition. Two sides of the elastic portion 211 are accommodated in the slots 1331 but do not abut the side surfaces of the slots 1331. A stopping portion 23 is formed by extending downward from an upper edge of the through hole 2111 and inclining backward. A width of the through hole 2111 is respectively greater than the width of the oblique portion 22 and a width of the stopping portion 23 along the left-right direction. The stopping portion 23 enters the reserved space 14, and the stopping portion 23 and the bottom surface of the reserved space 14 match to stop the terminal 2 from moving downward. The terminal 2 is assembled in the accommodating slot 13 upward from bottom, and the recess portion 1321 provides a reserved space for the stopping portion 23, such that the terminal 2 can be smoothly assembled.

Two arm portions 24 are formed by extending upward from two sides of the base 21. Each arm portion 24 includes a horizontal arm 241 bending forward from each of two opposite sides of the base 21 and extending horizontally, and an elastic arm 242 obliquely extending upward from a tail end of the horizontal arm 241. A clamping portion 25 extends from the tail end of each elastic arm 242. A clamping space 251 is formed between the two clamping portions 25 of the two arm portions 24. The contact surface 221 enters the clamping space 251, and the guide surface 222 does not enter the clamping space 251. Two guiding portions 252 are formed by bending and extending forward from the two clamping portions 25 and toward directions away from each other, and are used to guide the insertion pin 201 to horizontally enter the clamping space 251. A front edge of each guiding portion 252 forms a guide edge 253. An included angle between the guide edge 253 and the upper end of the guiding portion 252 is an obtuse angle. The guide edge 253 is used to guide the terminal 2 to be assembled in the accommodating slot 13 upward from bottom. A bending line L at a connecting location of the guiding portion 252 and the corresponding clamping portion 25 is an oblique line. The oblique line inclines backward and upward from bottom. The base 21 further includes a retaining portion 26 lower than the arm portion 24. The retaining portion 26 and the slots 1331 match to retain the terminal 2. Two clamping arms 27 extend downward from the retaining portion 26 to clamp a solder 3. A maximum distance between the two clamping arms 27 is greater than a distance between the left side wall 133 and the right side wall 134 along the left-right direction. Therefore, the clamping arms 27 can stop the terminal 2 from excessively moving upward.

When the chip module 200 is mounted on the upper cover 4, the guide surface 222 of the front terminal 2 in the two adjacent terminals 2 in the front-rear direction guides the insertion pin 201 to be inserted downward. Then, the insertion pin 201 horizontally slides by the horizontal movement of the upper cover 4. Then, the guiding portion 252 of the rear terminal 2 guides the insertion pin 201 to horizontally move into the clamping space 251, such that the clamping portion 25 and the contact surface 221 jointly clamp the insertion pin 201 of the chip module 200.

To sum up, the electrical connector 100 according to certain embodiments of the present invention have the following beneficial effects:

(1) The reserved space 14 is provided between the two adjacent accommodating slots 13 in the front-rear direction to reserve for a corresponding insertion pin 201, such that the terminals 2 can be arranged more densely. The terminal 2 is provided with the oblique portion 22. The rear surface of the oblique portion 22 forms the guide surface 222. When the chip module 200 is mounted, the insertion pin 201 is inserted downward under the guidance of the guide surface 222 of the terminal 2 in front of the insertion pin 201, thereby reducing a risk of slant insertion of the insertion pin 201. The front surface of the oblique portion 22 forms the contact surface 221, such that a sufficient elastic pressing force can be generated when the contact surface is in contact with the insertion pin 201, so as to ensure a stable contact with the insertion pin 201.

(2) The elastic portion 211 is connected with the stopping portion 23 and the oblique portion 22. When the terminal 2 is assembled in the accommodating slot 13 upward from bottom, the elastic portion 211 provides elasticity for the stopping portion 23 to enable the terminal 2 to be smoothly assembled. When the insertion pin 201 of the chip module 200 horizontally moves into the clamping space 251, the elastic portion 211 provides elasticity for the oblique portion 22, such that the contact surface 22 of the oblique portion 22 is in good contact with the insertion pin 201.

(3) The rear side wall 132 of the accommodating slot 13 is provided with a recess portion 1321. When the terminal 2 is mounted, the recess portion 1321 provides a reserved space for the stopping portion 23, such that the terminal 2 is smoothly assembled into the accommodating slot 13.

(4) The front edge of the guiding portion 252 forms a guide edge 253, and an included angle between the guide edge 253 and the upper end of the guiding portion 252 is an obtuse angle, resulting in that the guide area of the guiding portion 252 has a narrow upper side and a wide lower side. A bending line L at a connecting location of the guiding portion 252 and the clamping portion 25 is an oblique line, and the oblique line inclines backward and upward from bottom. In this case, the upper guide area of the guiding portion 252 is increased, thereby making it convenient for the insertion pin 201 to enter the clamping space 251.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, configured to be electrically connected to a chip module having a plurality of insertion pins, the electrical connector comprising:

an insulating body, provided with a plurality of accommodating slots running through the insulating body vertically, wherein a reserved space is provided between two adjacent accommodating slots of the accommodating slots in a front-rear direction to interconnect the two adjacent accommodating slots, and the reserved space is configured to correspondingly reserve for a corresponding insertion pin of the insertion pins; and a plurality of terminals, correspondingly accommodated in the accommodating slots, wherein each of the terminals comprises a base being flat plate shaped and two arm portions extending upward from the base, the two arm portions have two clamping portions and two guiding portions formed by bending and extending forward from the two clamping portions and toward directions away from each other, an oblique portion is formed by bending forward from the base and extending upward, a front surface of the oblique portion has a contact surface, the contact surface and the two clamping portions are configured to jointly clamp the corresponding insertion pin, a rear surface of the oblique portion has a guide surface, a top end of the guide surface is higher than a bottom surface of the reserved space;

wherein the terminals comprise two adjacent terminals in the front-rear direction, and when the chip module is mounted, the guide surface of a front terminal of the two adjacent terminals guides the corresponding insertion pin to be inserted downward, and then the guiding portions of a rear terminal of the two adjacent terminals guides the corresponding insertion pin to move horizontally.

2. The electrical connector of claim 1, wherein:

the base comprises an elastic portion connected to a bottom end of the oblique portion, and a width of the elastic portion is greater than a width of the oblique portion along a left-right direction;

the bottom surface of the reserved space is lower than the bottom end of the oblique portion, and the reserved space is located behind the elastic portion to provide an elastic deformation space for the elastic portion; and a stopping portion extends downward from the elastic portion and inclines backward to stop the corresponding terminal from moving downward.

3. The electrical connector of claim 2, wherein the stopping portion enters the reserved space, and the stopping portion and the bottom surface of the reserved space match to stop the corresponding terminal from moving downward.

4. The electrical connector of claim 2, wherein the base has a through hole being of an enclosed quadrangle shape, the stopping portion is formed by extending downward from an upper edge of the through hole and inclining backward, and a width of the through hole is respectively greater than the width of the oblique portion and a width of the stopping portion along the left-right direction.

5. The electrical connector of claim 2, wherein the base further comprises a retaining portion lower than the arm portions, the retaining portion and the corresponding accommodating slot match to retain the corresponding terminal, and a width of the retaining portion is greater than the width of the elastic portion along the left-right direction.

6. The electrical connector of claim 5, wherein a left side wall and a right side wall of each of the accommodating slots are respectively provided with two slots running through the insulating body vertically, the retaining portion and the two slots of the corresponding accommodating slot match to retain the corresponding terminal, and two sides of the elastic portion are accommodated in the slots and do not abut the side surfaces of the slots.

7. The electrical connector of claim 2, wherein a rear side wall of each of the accommodating slots is provided with a recess portion running downward through a bottom surface of the insulating body, and a top surface of the recess portion is lower than the bottom surface of the reserved space.

8. The electrical connector of claim 1, wherein a bottom surface of each of the insertion pins is lower than a bottom end of the oblique portion.

9. The electrical connector of claim 1, wherein a front edge of each of the guiding portion forms a guide edge, an included angle between the guide edge and an upper end of the guiding portion is an obtuse angle, a bending line at a connecting location of each of the guiding portions and the corresponding clamping portion is an oblique line, and the oblique line inclines backward along a direction upward from bottom.

10. The electrical connector of claim 1, wherein a clamping space is formed between the two clamping portions, the contact surface enters the clamping space, and the guide surface does not enter the clamping space.

* * * * *